US005980352A

United States Patent [19]

Rigberg

[11] Patent Number: 5,980,352

[45] Date of Patent: Nov. 9, 1999

[54] PACKAGE FOR A CHARACTER FIGURE AND STAGE PROPS

[76] Inventor: Allan Rigberg, 4 Jib St., Marina Del Rey, Calif. 90292

[21] Appl. No.: 09/056,129

[22] Filed: Apr. 7, 1998

[51] Int. Cl.[6] ..... A63J 19/00; B65D 73/00; B65D 25/54

[52] U.S. Cl. ..... 446/73; 446/82; 446/487; 206/457; 206/776

[58] Field of Search ..... 446/82, 83, 147, 446/148, 75, 73, 478, 487; 206/457, 776, 777, 778, 459.5

[56] References Cited

U.S. PATENT DOCUMENTS

| | | | |
|---|---|---|---|
| 1,176,209 | 3/1916 | Dice | 446/376 |
| 1,273,605 | 7/1918 | Goldman . | |
| 1,662,899 | 3/1928 | Ridgway et al. . | |
| 1,990,671 | 2/1935 | Redington . | |
| 3,060,632 | 10/1962 | Wagner . | |
| 3,108,684 | 10/1963 | Apicella . | |
| 3,675,362 | 7/1972 | De Gelder et al. . | |
| 4,129,210 | 12/1978 | Brown et al. . | |

*Primary Examiner*—Robert A. Hafer
*Assistant Examiner*—Laura Fossum
*Attorney, Agent, or Firm*—Michael Ebert

[57] ABSTRACT

A package adapted to stage a performance by a toy figure resembling a known character. The package includes a carton whose a flat rear wall is joined to a semi-cylindrical front wall to define a cavity, the front wall having a bay window therein. Behind the rear wall and hinged thereto a flap that is normally folded over the rear wall and fastened thereto. When the flap is unfolded, it creates in combination with the rear wall a stage backdrop having printed thereon material relating to the character, such as dialog taken from movies involving the character. Received within the cavity is an insert on which is mounted the figure, as well as a miniature stage and stage props, all of which can be seen through the window. In play, the flap is unfolded to erect the stage backdrop, the stage is placed in front of the backdrop with the figure standing thereon and with the props adjacent thereto. By manipulating the figure relative to the props against the backdrop, a player can enact a scene involving the character.

8 Claims, 3 Drawing Sheets

PACKAGE FOR A CHARACTER FIGURE AND STAGE PROPS

BACKGROUND OF INVENTION

1. Field of Invention

This invention relates generally to packages for toys and playthings, and more particularly to a package adapted to stage a performance of a toy figure which resembles a known character, the package containing the figure, as well as stage props and a miniature stage necessary to the performance.

2. Status of Prior Art

A character, in the sense this term is used in the field of toys and playthings, is a personality created by an actor in a motion picture, stage or television show. Thus Charlie Chaplin, the silent movie star is still remembered for the character he created in the movie "The Tramp." This classic character who swings a cane as he walks, wears a derby hat, baggy pants and oversize shoes. The characters created by the team of Stan Laurel and Oliver Hardy, the movie comedians, are classics, as are those created by The Three Stooges and the Marx Brothers.

While many of these characters go back in motion picture history at least 50 years, because movies involving these characters are often shown on television, these characters remain well known. Thus "Laurel and Hardy" are as familiar to children today as they were in their heyday.

Children who have seen these movies on a television screen have not only taken the characters to heart, but have committed to memory familiar bits of dialog. Thus in almost every Laurel and Hardy movie there is a climactic scene in which Oliver Hardy says to Stan Laurel "Here's another fine mess you've gotten me into, Stanley!"

Toy dolls and figures resembling celebrated characters are popular in the toy field, these figures being manufactured under a character license granted by the owner of the copyright. It is the usual practice to package a toy character in a box having a transparent cover, for then the contents of the box are visible. However, once the character is taken out of the box, the box has no further use and is discarded.

A child who plays with a toy figure resembling a character then seeks to recreate an activity in which the character was involved in a movie the child had seen. If this activity requires the character to turn his head, lift an arm or swing a leg, the child cannot imitate this activity if the figure is rigid and the arms and legs are not articulated. And if this activity requires the character to climb a ladder or paint a ceiling, the child must improvise props for this purpose.

Thus lacking in existing packages for toy characters are the props and other articles necessary for a child to simulate a performance involving the character.

In a typical package for a toy, whether the toy is a character figure, a toy vehicle or any other plaything, the package makes use of a carton having opaque walls. Hence the actual nature of the packaged toy is not evident to a prospective purchaser whose impression of the package contents is gained only from a picture of the toy printed on the face of the carton.

Since a package in accordance with the invention includes a box or carton having an extra panel or flap hinged to a wall of the carton, of prior art interest are the following references all of which show a similar arrangement:

A. U.S. Pat. No. 3,099,381—Meyer—"Extra Panel Carton"

B. U.S. Pat. No. 5,293,994—Ankik—"Video Cassette Package"

C. U.S. Pat. No. 5,548,235—Stone—"Gift Product"

D. U.S. Pat. No. 5,641,062—Burton—"Combined Greeting Card and Gift Box Apparatus"

E. European patent application 0455048 A1 (1991)—Lo Duca—"Box with a supplementary raisable panel prontable on both sides"

SUMMARY OF INVENTION

In view of the foregoing, the main object of this invention is to provide a package in which is stored a figure resembling a character, the package being adapted to stage a performance involving the character.

More particularly an object of this invention is to provide a package of the above type in which is stored not only the character, but also stage props necessary to the performance.

A significant feature of a package in accordance with the invention is that the package includes a carton having a plastic bay window in its front wall which exposes to view the entire contents thereof including the figure of the character and stage props, whereby a prospective purchaser can view what he will acquire should he purchase the package.

Also an object of the invention is to provide a package which is convertible into a stage backdrop.

Briefly stated, these objects are attained by a package adapted to stage a performance by a toy figure resembling a known character. The package includes a carton whose flat rear wall is joined to a semi-cylindrical front wall to define a cavity, the front wall having a bay window therein. Behind the rear wall and hinged thereto is a flap that is normally folded over the rear wall and fastened thereto.

When the flap is unfolded, it creates in combination with the rear wall a stage backdrop having is printed thereon material relating to the character, such as dialog taken from movies involving the character. Received within the cavity is an insert on which is mounted the figure, a miniature stage and stage props, all of which can be seen through the window. In play, the flap is unfolded to erect the stage backdrop, the stage is placed in front of the backdrop with the character standing thereon and with the props adjacent thereto. By manipulating the character relative to the props against the backdrop, a player can enact a scene involving the character.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
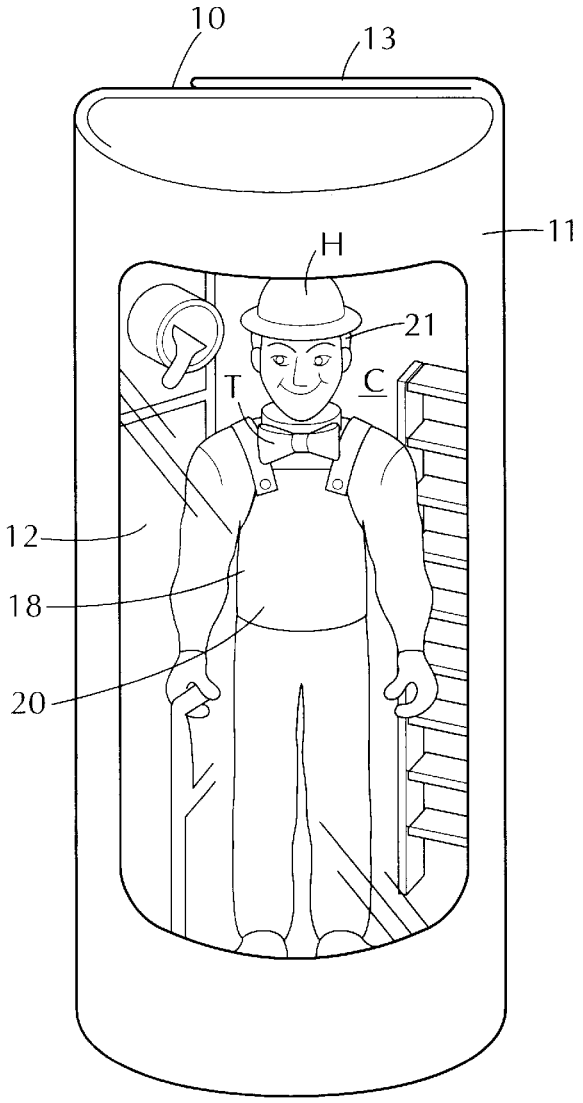
FIG. 1 is a perspective view of a package in accordance with the invention, as seen from the front of the package, the package including a semi-cylindrical carton having a rear wall joined to a bellied out front wall to define a cavity.
Figure 2:
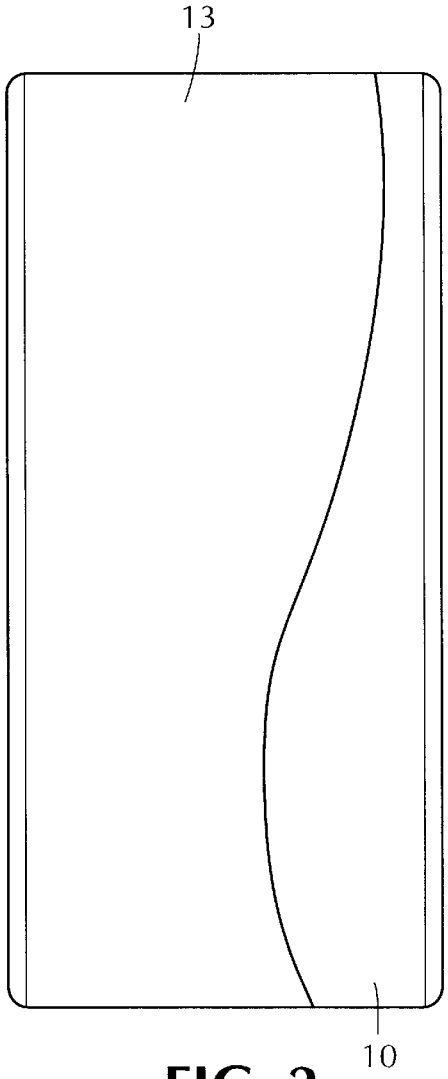
FIG. 2 is a rear view of the package.
Figure 3:
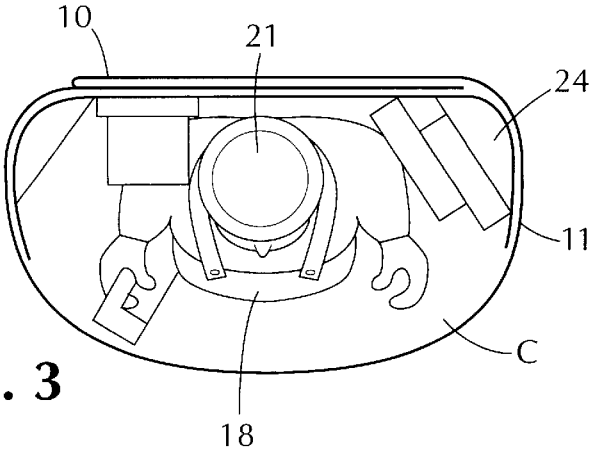
FIG. 3 is a top view of the package.

Referring now to FIGS. 1 to 3, shown therein is a package in accordance with the invention containing a figure resembling a character and various accessories. The package includes a cardboard carton having a flat rectangular rear wall 10 which is joined to a semi-cylindrical front wall 11 to define a vertical cavity C having a semi-circular cross section.

A major portion of the bellied out front wall is cut out to create a large opening that is covered by a curved sheet 12 of transparent synthetic plastic material, such as polyvinyl chloride, to form a bay window through which the contents of the package can be seen. The overall appearance of the package, as shown in FIG. 1, which has a semicircular base is that of a kiosk displaying the figure and the accessories.

Figure 5:
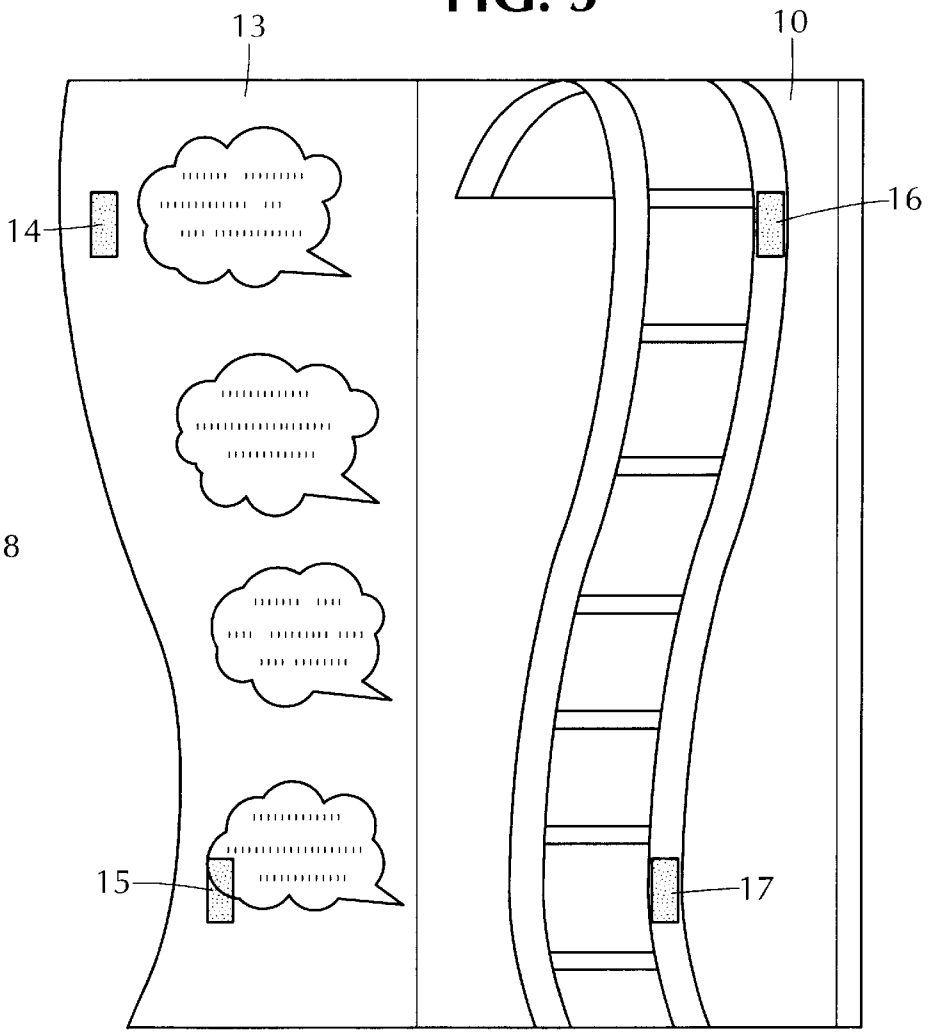
FIG. 5 shows the rear of the carton where the flap hinged thereto is unfolded to create a backdrop.

Hinged to one side of rear wall 10, as shown in FIGS. 2 and 5, is a flap 13 whose outer edge is contoured to expose a portion of the rear wall. Flap 13 is normally folded, as shown in FIG. 2, over rear wall 10 and fastened thereto. To this end, as shown in FIG. 5, flap 13 is provided with a pair of female Velcro fastener patches 14 and 15 placed at upper and lower sites adjacent the outer edge of the flap. Attached to rear wall 10 at corresponding sites are male Velcro fastener patches 16 and 17. Hence when the flap is folded to overlie the rear wall, it is then fastened thereto by the Velcro fasteners. However, it is a simple matter to pull out flap 13 to disengage the Velcro fasteners and fold out the folded out flap so that it is then coplanar with rear wall 10. As shown in FIG. 5 flap 13 in combination with rear wall 10 then provides a stage backdrop for a performance by the character stored in the package.

Figure 4:
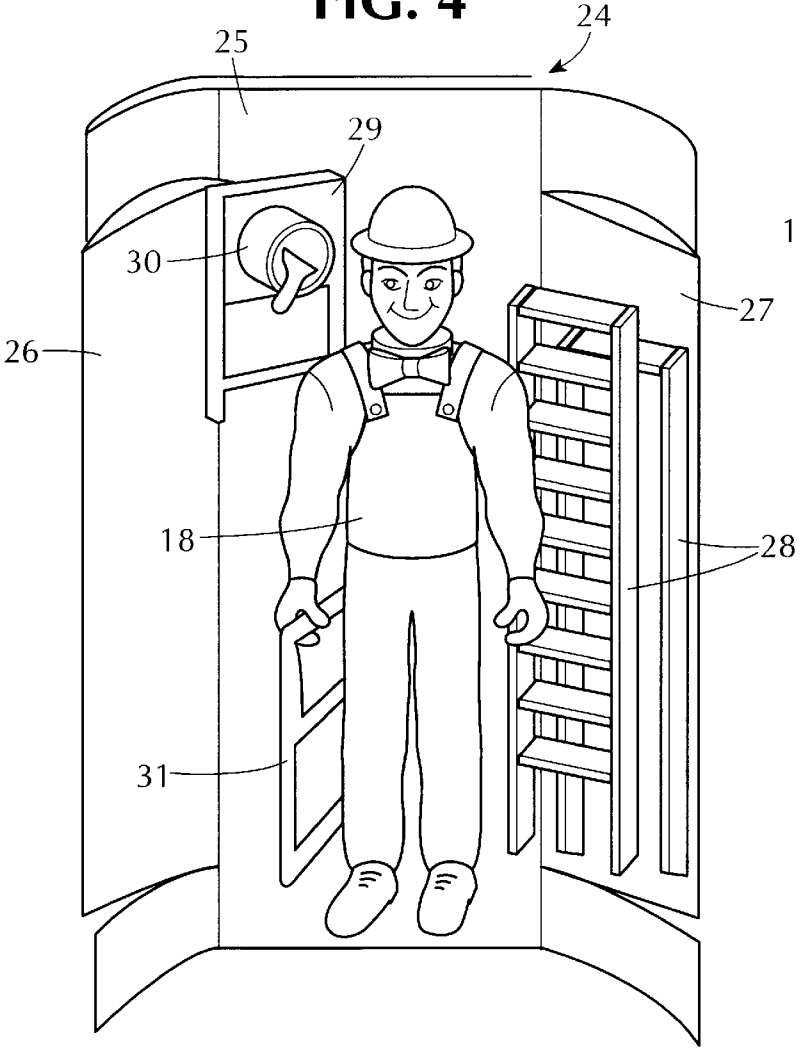
FIG. 4 separately illustrates the insert received in the cavity of the carton, the insert being loaded with a figure, a miniature stage and a stage prop in the form of a painter's ladder.
Figure 6:
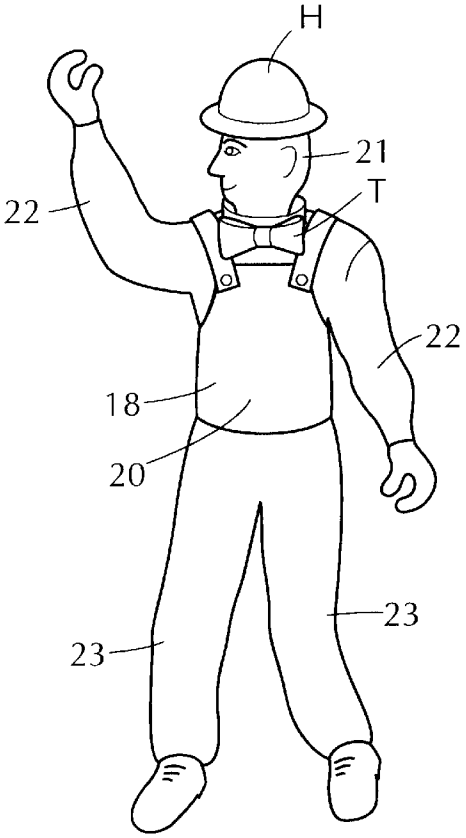
FIG. 6 is a separate view of the figure.

By way of example, FIG. 18 shown in FIGS. 1, 4 and 6 resembles the character Stan Laurel of the comedy team of Laurel and Hardy. When Stan Laurel is in character he wears a derby hat H and a bow tie T. In the figures, Laurel is shown in a pair of overalls 20, for in the performance to be given, he is to assume the role of a house painter.

The head 21 of FIG. 18 is swiveled so that it can be turned, and both the pair of arm 22 and the pair of legs 23 are articulated so that these appendages can be bent to assume any desired posture. Thus in FIG. 6, head 21 is turned to one side, one arm 22 is raised while the other is outstretched, and one leg 23 is extended rearwardly to be behind the other leg. Thus a child playing with FIG. 18 can manipulate it to assume various postures.

Received within cavity C of the cardboard carton is a cardboard insert 24 which, as shown in FIG. 4, has a main rectangular panel 25 and folded wings 26 and 27 hinged to opposite sides of the main panel.

The dimensions of main panel 25 match those of rear wall 10 of the carton. Hence when insert 24 is received in cavity C, the main panel 25 then lies against the rear wall 10 whereas the folded wings 26 and 27 engage and press against opposing sides of the bellied-out front wall 11 of the carton, thereby snugly retaining the insert in the cavity.

Mounted against main panel 25 of insert 24 and held thereto by plastic wires is the character FIG. 18. Mounted against folded wing 27 and held thereto by plastic wires are the complementary sections of a miniature painter's ladder 28. Also mounted by plastic wires on main panel 25 adjacent wing 26 is a ladder shelf 29 on which is rested a paint-can 30 in which a paint brush is immersed. And lying against main panel 25 adjacent wing 26 is a miniature stage or platform 31 which character 18 appears to be holding with one hand.

For a child to give a performance which is in keeping with a movie scene played by the character of FIG. 18, we shall assume that since the character shown is Stan Laurel, that the scene to be enacted is one in which Laurel in the role of a house painter must step on a ladder to reach a ceiling to be painted with paint taken from a paint can on the shelf of the ladder.

And one can also assume that since this is a comedy, and Stan Laurel is notoriously inept, that he loses his balance and falls off the ladder, paint from the can then splattering the floor.

Figure 7:
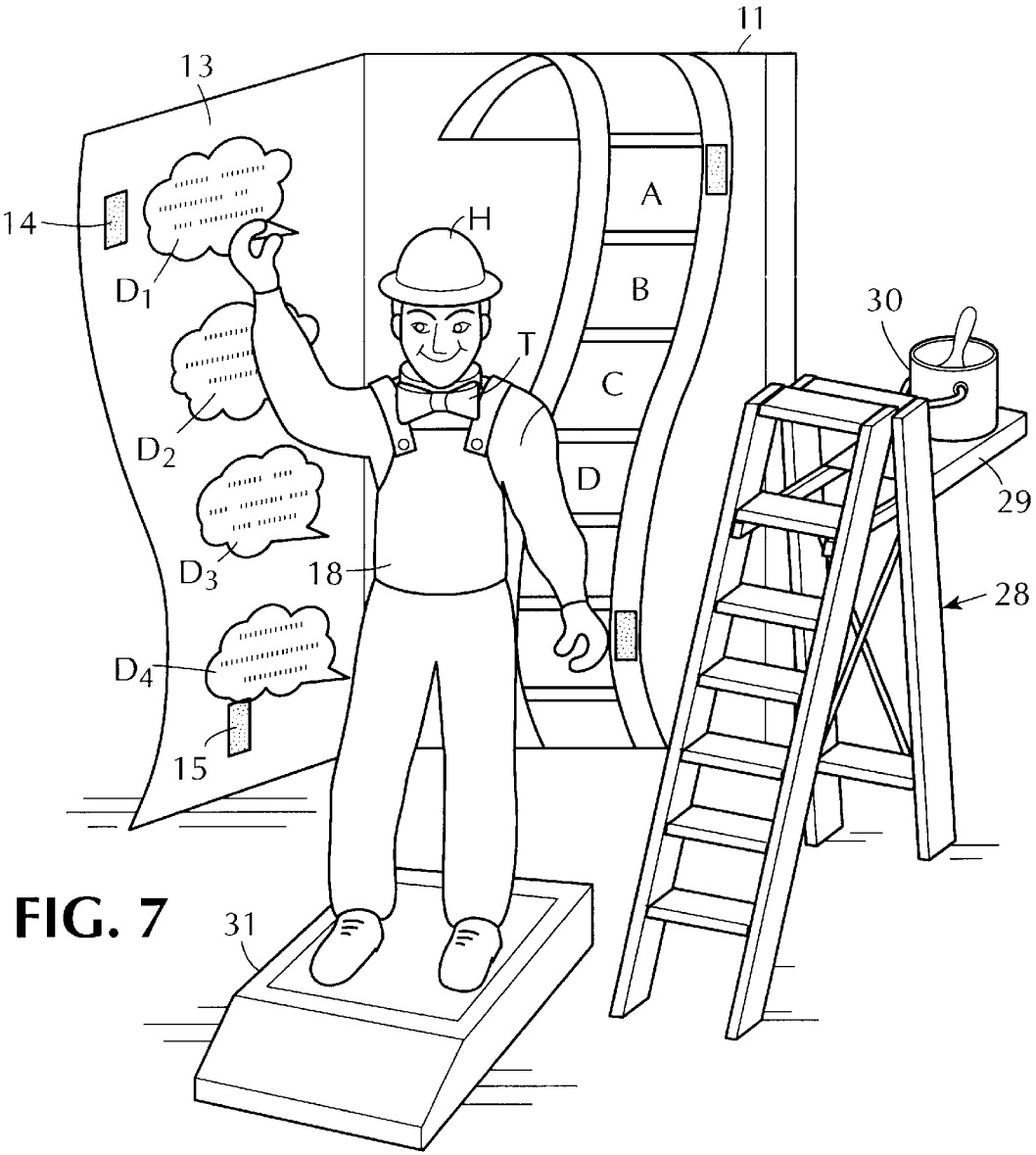
FIG. 7 illustrates a performance by the figure who stands on a stage in front of the backdrop.

To set up this scene, flap 13 is unfolded, as shown in FIG. 7 to create with rear wall 10 a stage backdrop. The backdrop is printed to display material associated with Laurel and Hardy. Thus on rear wall 10 there is a series of picture frames A to E taken from scenes in various Laurel and Hardy movies. And on flap 13 appearing in cartoon balloons are characteristic pieces of dialog $D_1$, $D_2$, $D_3$ and $D_4$ taken from Laurel and Hardy movies, such as "No use crying over spilt milk" and "I always got along swell with myself."

As the child recreates in conjunction with FIG. 18 a scene from a Laurel and Hardy movie, he can at the same time imitate the English-accented voice of Stan Laurel, using the printed dialog as his script for this purpose.

To set the scene, the child after having removed the insert from cavity C and having detached the pieces mounted thereon, then places the miniature stage 31 in front of the backdrop 10–13, as shown in FIG. 7 and stands FIG. 18 on this stage. The child assembles ladder 28, puts shelf 29 in the ladder so that paint can 30 is then adjacent the top rung of the ladder, and places the ladder near the figure.

Once the scene is set, the child can manipulate the figure to cause it to assume any posture; he can have the figure move up the ladder, and improvise whatever show his imagination conceives and is suggested by the dialog suggested by the backdrop.

The kiosk-like package which displays the character and various props which are used by the character in a performance has a strong appeal to children, for a child is quick to recognize the performing potential of the character. And the child can examine the stage backdrop without having to break open the package.

It must be understood that the character illustrated and the accessories related to this character represent but one example of a useable character, for there is virtually no limit to the choice of characters suitable for the package. And the characters need not be actors, for they may also be puppets, such as the characters in a Sesame Street TV show.

While there has been shown a preferred embodiment of a package in accordance with the invention, it is to be understood that many changes may be made therein without departing from the spirit of the invention.

I claim:

1. A package adapted to stage a performance, said package comprising:

an articulated figure resembling a known character and adjustable by a player by articulating body parts of the character into a variety of positions;

a carton having a flat rear wall joined to a semi-cylindrical front wall to define a cavity in which is received said figure and a stage for supporting said figure, said front wall having a large opening therein covered by a transparent sheet to form a bay window through which the figure is seen, whereby the carton resembles a kiosk, said rear wall defined by an inner surface adjacent the cavity of the carton and on outer surface on an exposed outside surface of the carton; and a flap hinged to the outer surface of the rear wall, said flap normally folded over and releasably fastened to said outer surface of the rear wall, said flap designed and configured to be folded out to form a plane with the rear wall so as to form a stage backdrop having indicia on said flap and said outer surface, said indicia being associated with said known character such that when said figure and said stage are removed from said carton and said figure is placed on said stage in front of said stage backdrop, a performance of said known character is simulated.

2. A package as set forth in claim 1, in which the carton is formed of cardboard and the sheet is formed of transparent synthetic plastic material.

3. A package as set forth in claim 1, in which said figure is mounted on an insert which is inserted in the cavity and lies against the rear wall thereof.

4. A package as set forth in claim 3, in which the insert is a panel having folded wings hinged to opposite sides thereof, said panel lying against the rear wall, said wings engaging opposite sides of the semi-cylindrical front wall to retain the insert within the cavity.

5. A package as set forth in claim 4, further including a miniature ladder mounted on said insert.

6. A package as set forth in claim 1, in which printed on said backdrop are picture frames taken from motion pictures in which said character appeared.

7. A package as set forth in claim 6, in which also printed on said back drop are snatches of dialog taken from said motion pictures.

8. A package as set forth in claim 1, in which said figure has a swiveled head and articulated arms and legs whereby the posture of the figure can be adjusted by a player.

* * * * *